US008939334B2

(12) United States Patent
Prestwich

(10) Patent No.: US 8,939,334 B2
(45) Date of Patent: Jan. 27, 2015

(54) HOLSTER CLIP FOR A CONCEALED ITEM

(71) Applicant: Matthew C. Prestwich, Murray, UT (US)

(72) Inventor: Matthew C. Prestwich, Murray, UT (US)

( * ) Notice: Subject to any disclaimer, the term of this patent is extended or adjusted under 35 U.S.C. 154(b) by 217 days.

(21) Appl. No.: 13/762,716

(22) Filed: Feb. 8, 2013

(65) Prior Publication Data

US 2013/0306693 A1 Nov. 21, 2013

Related U.S. Application Data

(60) Provisional application No. 61/647,646, filed on May 16, 2012.

(51) Int. Cl.
*A45F 5/00* (2006.01)

(52) U.S. Cl.
USPC ..... 224/269; 224/587; 224/904; 224/912

(58) Field of Classification Search
USPC ..... 224/269, 587, 904, 912, 192, 193
See application file for complete search history.

(56) References Cited

U.S. PATENT DOCUMENTS

| | | | | | |
|---|---|---|---|---|---|
| 3,804,306 | A * | 4/1974 | Azurin | 224/193 |
| 3,854,639 | A * | 12/1974 | Genchi | 224/234 |
| 4,253,592 | A * | 3/1981 | Anderson | 224/198 |
| 4,424,924 | A * | 1/1984 | Perkins | 224/668 |
| 4,450,992 | A * | 5/1984 | Casull | 224/163 |
| 4,591,081 | A * | 5/1986 | Bianchi et al. | 224/192 |
| 4,787,540 | A * | 11/1988 | Barry | 224/192 |
| 4,925,075 | A * | 5/1990 | Rogers | 224/244 |
| 5,282,559 | A * | 2/1994 | Wisser et al. | 224/243 |
| 5,528,770 | A * | 6/1996 | Castilla et al. | 340/7.63 |
| 5,881,938 | A * | 3/1999 | Wakefield | 224/587 |
| 6,161,742 | A * | 12/2000 | Kiser | 224/251 |
| 6,405,910 | B1 * | 6/2002 | Infanti et al. | 224/668 |
| 2005/0184115 | A1 * | 8/2005 | Wells | 224/193 |
| 2008/0083798 | A1 * | 4/2008 | Broadwell et al. | 224/269 |
| 2009/0321480 | A1 * | 12/2009 | Kincaid et al. | 224/243 |

* cited by examiner

*Primary Examiner* — Brian D Nash
(74) *Attorney, Agent, or Firm* — Geoffrey E. Dobbin; Dobbin IP Law P.C.

(57) ABSTRACT

The present invention is a holster clip that allows conversion of most generic holsters into a concealable holster which allows a wearer to tuck a shirt or jacket within the waistband of the wearer's pants. The holster clip is fashioned in an "M" shape, with longer inner walls forming a deep passage to allow space for the shirt or jacket and a structure to form a pant clip between a first outer wall and a first inner wall. An alternate embodiment forms the clip from two pivoting or non-pivoting halves to allow for canting and color coordination for further camouflage of the holster.

20 Claims, 9 Drawing Sheets

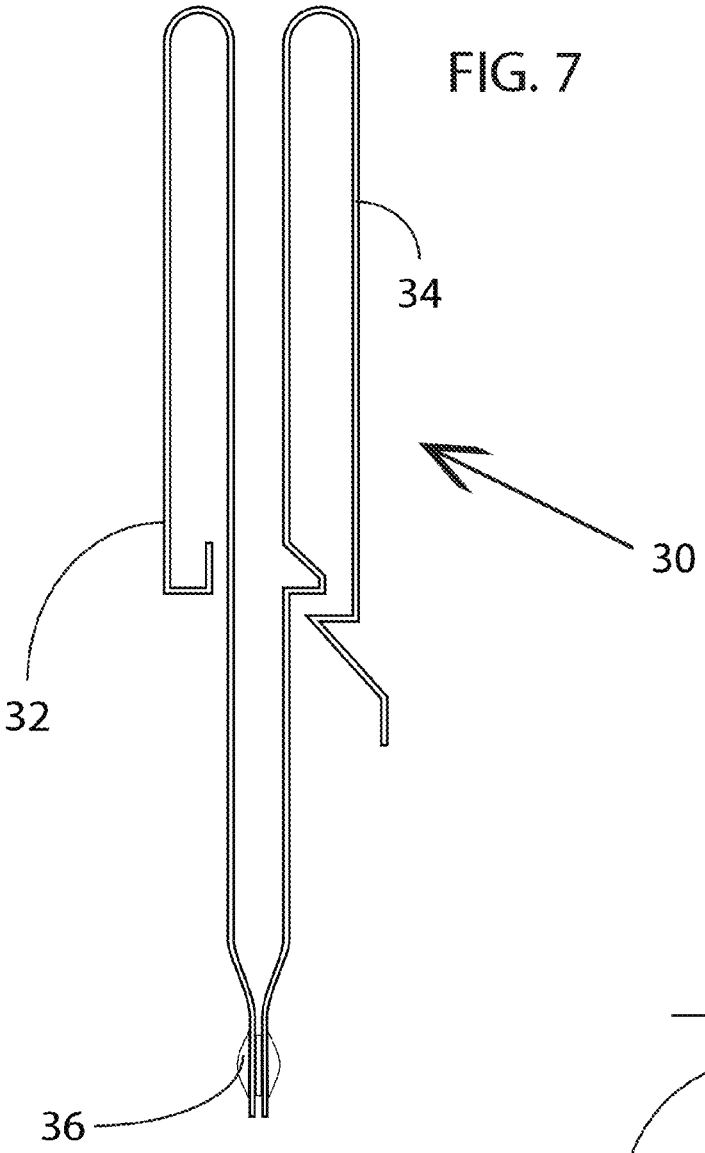
FIG. 7
FIG. 8
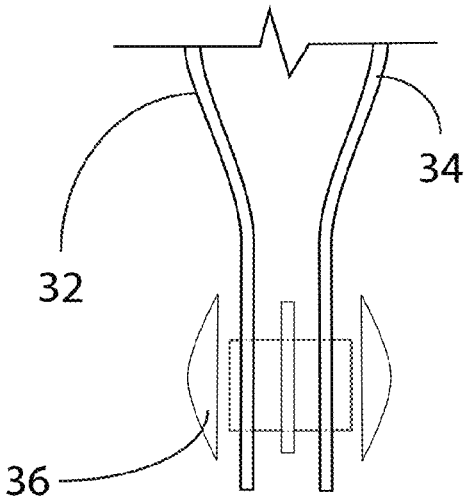

HOLSTER CLIP FOR A CONCEALED ITEM

CROSS-REFERENCES TO RELATED APPLICATIONS

The present application claims priority as a non-provisional perfection of prior filed U.S. provisional application No. 61/647,646 filed May 16, 2012 and incorporates the same by reference in its entirety herein.

FIELD OF THE INVENTION

The present invention relates to the field of holsters and more particularly relates to a holster clip attachable to a holster for an item, such as a firearm, that is attached to a wearer in a manner to conceal the item on the wearer's person.

BACKGROUND OF THE INVENTION

Holsters are used to carry many different items, including hand-held firearms. However, traditional holsters, and their contents, have tended to be viewable by others.

This has caused an intimidation effect that many in society find unacceptable. In some places and instances, exposure of a firearm to public view is actually illegal. It is therefore desirable to conceal a weapon so as to not intimidate others in one's vicinity. However, while concealing a weapon may be desirable, it is also necessary to be able to access and use the weapon rapidly. To this end, many holsters have been designed to both conceal a weapon and keep it within easy access. One type of such holster is concealed within the waistband of the wearer. However, early models of this type of holster had one design flaw—the shirt or jacket of the wearer could not be tucked into the pants without revealing the presence of the weapon. This limitation has been addressed by particular holsters with a lower connection point between the support clip and the holster body; but, to date, these holsters are manufactured and sold as a complete unit.

The present invention is a holster clip, attachable to any generic and suitable holster, which will then allow the holster to be worn inside the waistband of the wearer while also allowing a shirt or jacket tail to be simultaneously tucked into the waistband without revealing the presence of the weapon. The present invention represents a departure from the prior art in that the holster clip of the present invention allows for compatible holster, which is to say any holster that requires a clip to attach to a belt or similar article, to become a concealed and "tuckable" holster, rather than having to manufacture and or purchase an entire new holster for that function.

SUMMARY OF THE INVENTION

In view of the foregoing disadvantages inherent in the known types of holster clips, this invention provides a holster clip for a concealed item. As such, the present invention's general purpose is to provide a new and improved holster clip that is usable on the majority of generic holsters in today's market and also provides the advantage of concealment possibilities to the wearer.

To accomplish these objectives, the holster clip comprises an elongate strip of metal, plastic, composite or other suitable material that has been bent to form a deep "M" shape. The outer walls of the "M" are configured, one to interface with a holster the other to interface with the wearer's belt or similar article. The wearer then may tuck a shirt or jacket tail in the gap between the inner walls of the "M." In an alternate embodiment, halves of the "M" may be discrete from each other and fastened together at the lower vertex of the "M" by a rivet, screw or similar connector. This embodiment would allow for the possibility of a certain amount of cant in the holster, particularly when the wearer is moving or withdrawing the weapon. The clip, or a portion of the clip, may be colored to match, or at least closely resemble, pant and clothing colors commonly used in order to further disguise the clip against the wearer's clothing. In use with the two-piece embodiment, one side may be interchangeable, selected from a number of optional colored sides, and attachable to a "base" side.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 7 is a side elevation of the holster clip of FIG. 6

FIG. 8 is a close-up, exploded view of the bottom fastening point of the holster clip of FIG. 7.

DETAILED DESCRIPTION OF THE PREFERRED EMBODIMENT

With reference now to the drawings, the preferred embodiment of the holster clip is herein described. It should be noted that the articles "a", "an", and "the", as used in this specification, include plural referents unless the content clearly dictates otherwise. It should also be noted that while embodiments of the invention described in this specification are paired with a holster for a handgun, any holster for any item that is suitably structured to receive the holster clip of the present invention may be used. Accordingly, terms like "handgun," "weapon," or "firearm" should not be seen as limiting the invention only to use with such items.

Figure 1:
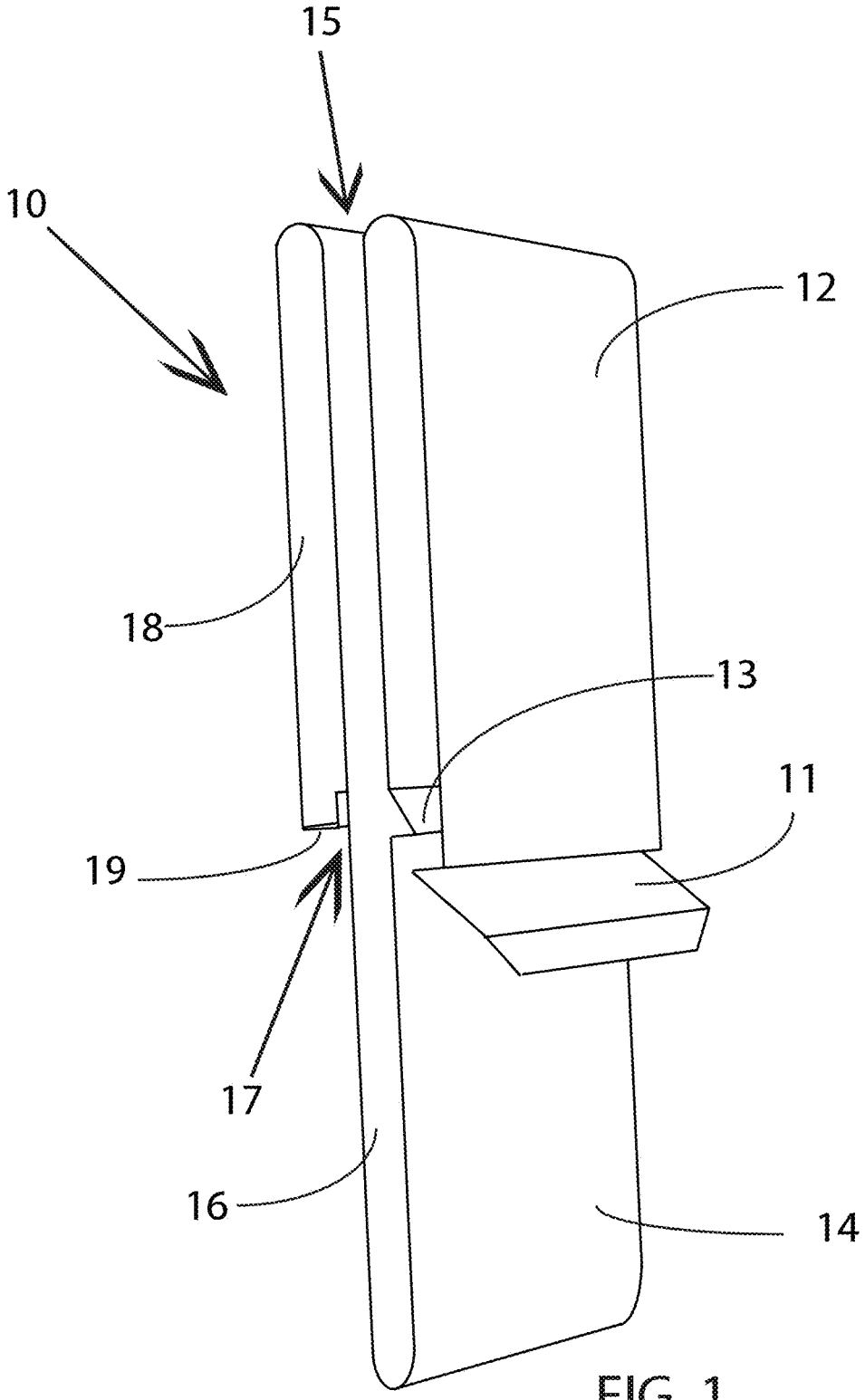
FIG. 1 is a perspective view of one embodiment of a holster clip according to the present invention.
Figure 2:
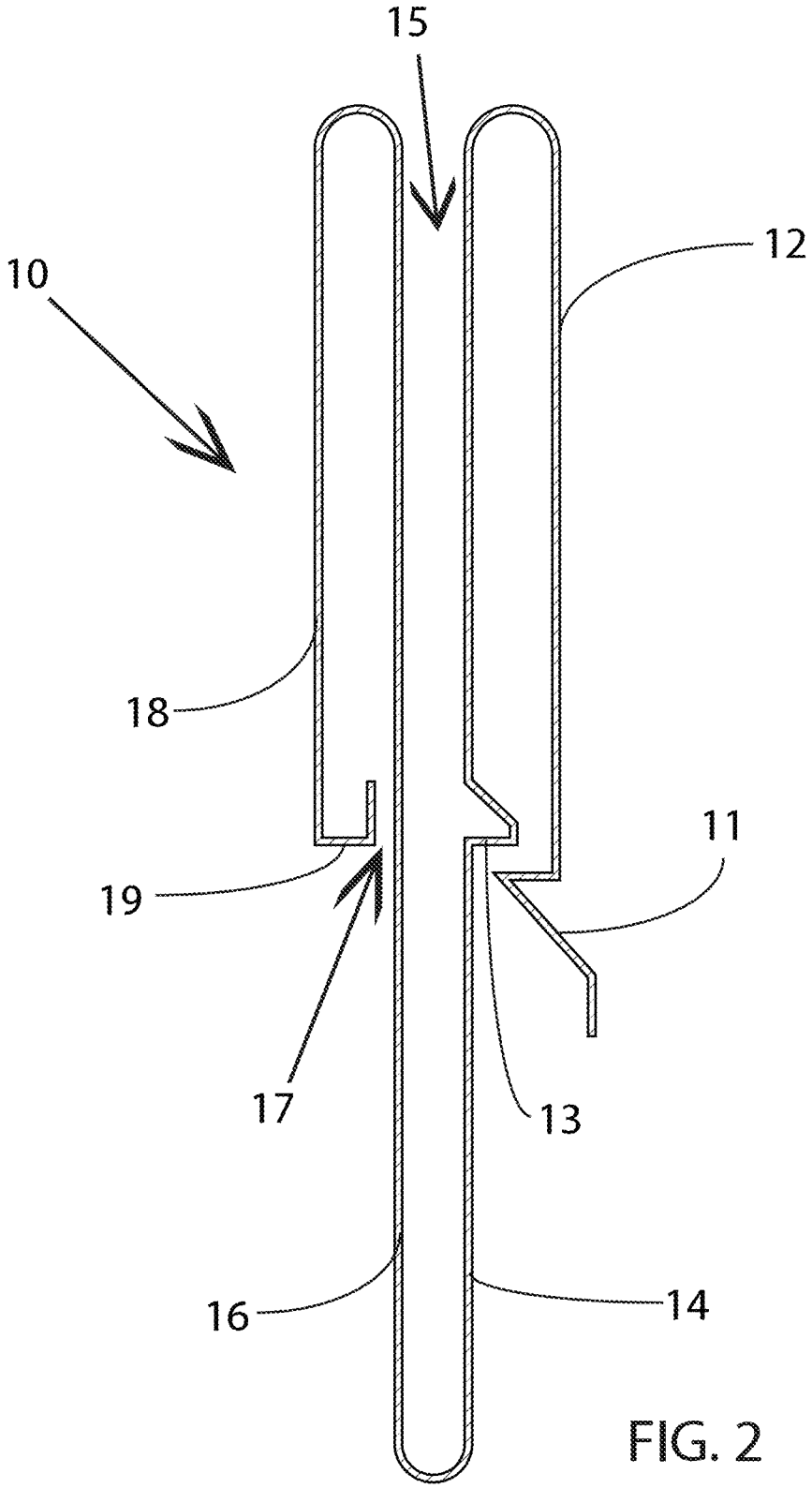
FIG. 2 is a side elevation of the holster clip of FIG. 1.

With reference to FIGS. 1 and 2, the holster clip 10 is generally shaped like a letter "M." A first outer wall 12 is generally shorter and is configured to clip onto a wearer's pant waistband with a first hem, or Dutch bend, 11 that forms a tooth. A second outer wall 18 is configured to interface with a holster's connection strap. The two inner walls 14, 16 are longer than the two outer walls and form a deep V-shaped space 15 between them. First inner wall 14 is bent in the middle to form a second hem 13. This second hem 13 interfaces with the tooth of the first hem 11 in the first outer wall 12 which then forms a clipping mechanism. The second inner wall and second outer wall are joined to form a passage 17 between them. The second outer wall 18 terminates with a trough 19 bent inward such that the trough is located in the passage 17.

Figure 3:
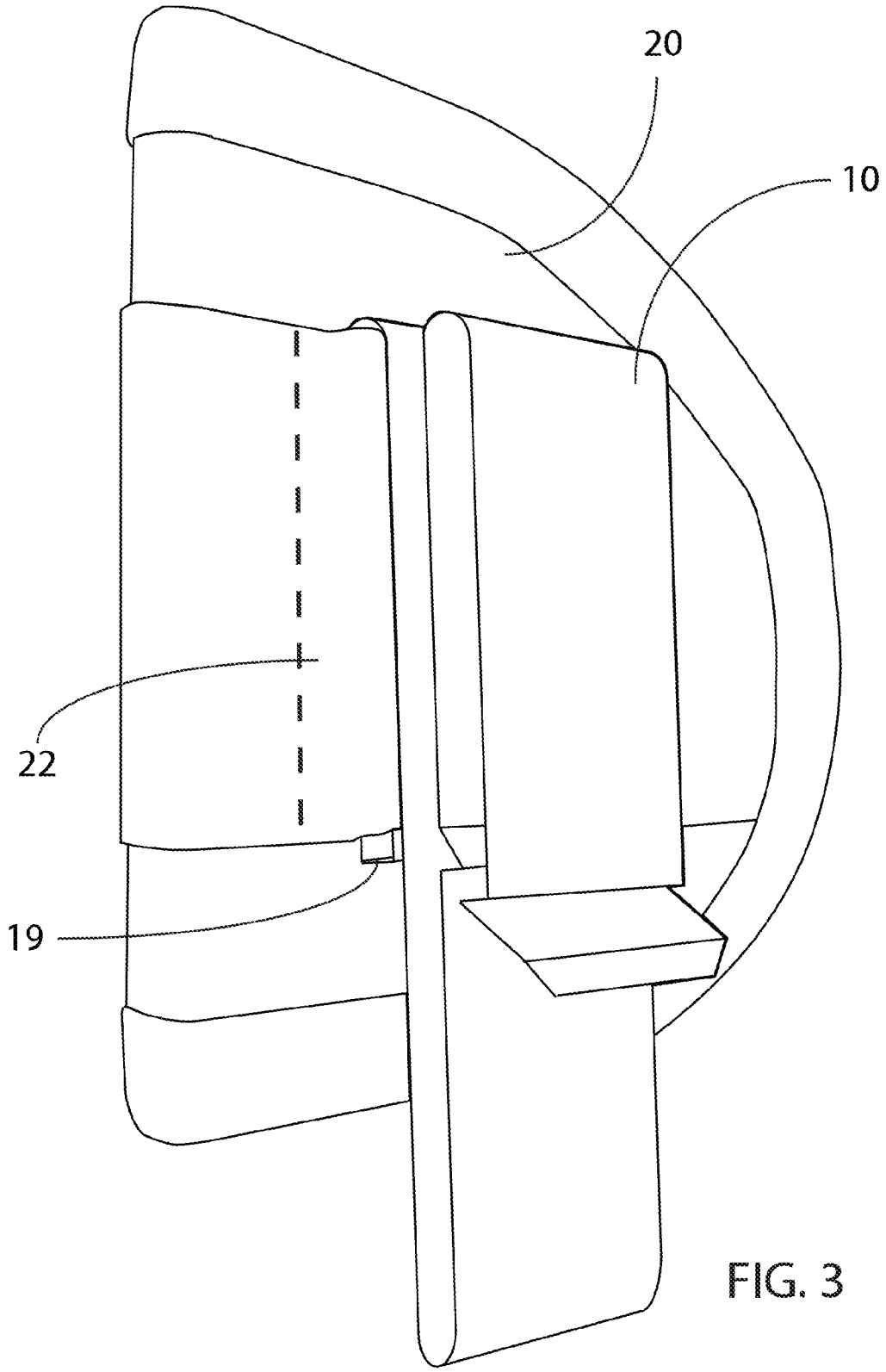
FIG. 3 is a perspective view of the holster clip of FIG. 1 installed on a generic holster.
Figure 4:
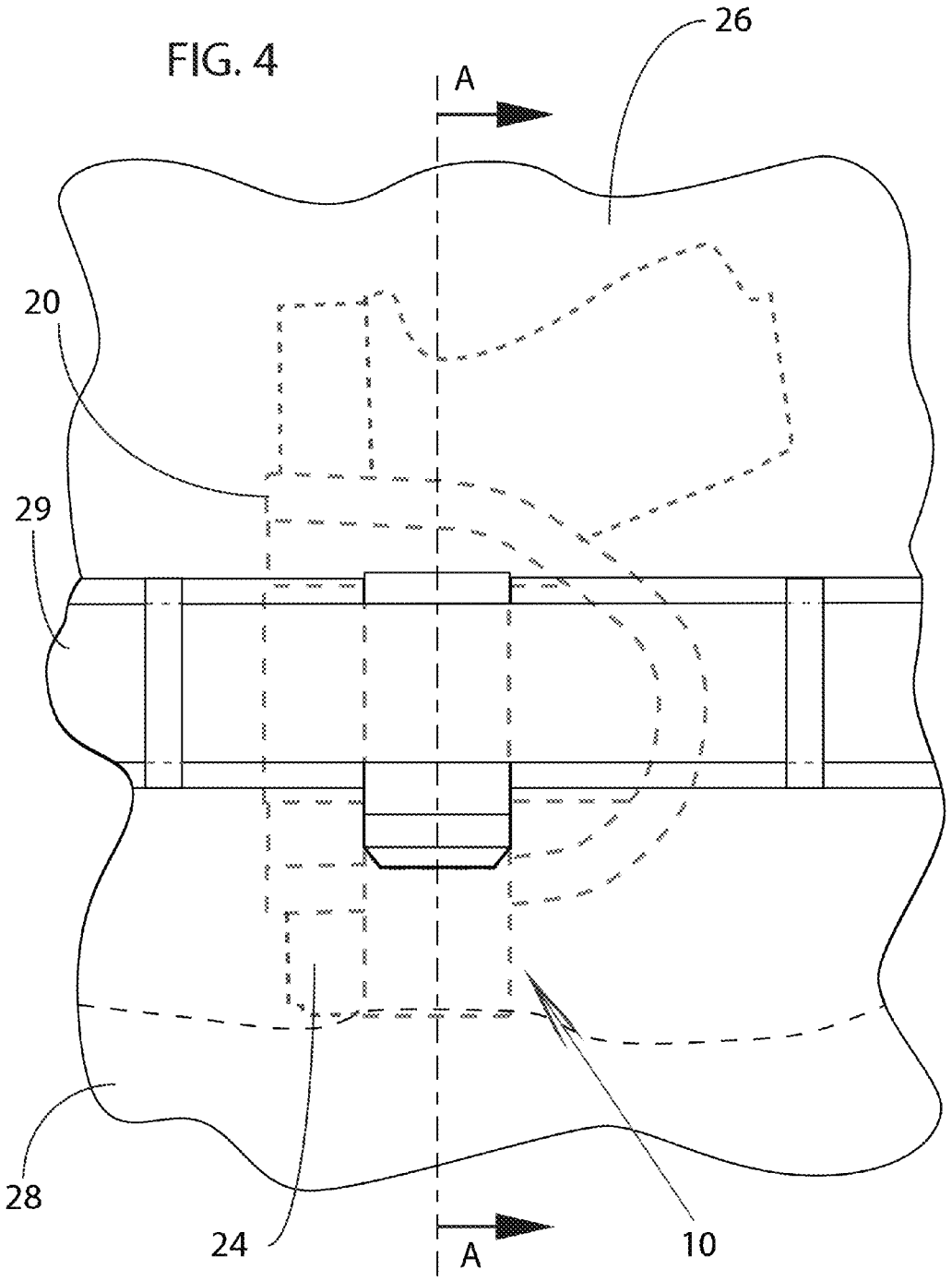
FIG. 4 is a partially transparent front elevation of the holster and holster clip combination of FIG. 3, in use.
Figure 5:
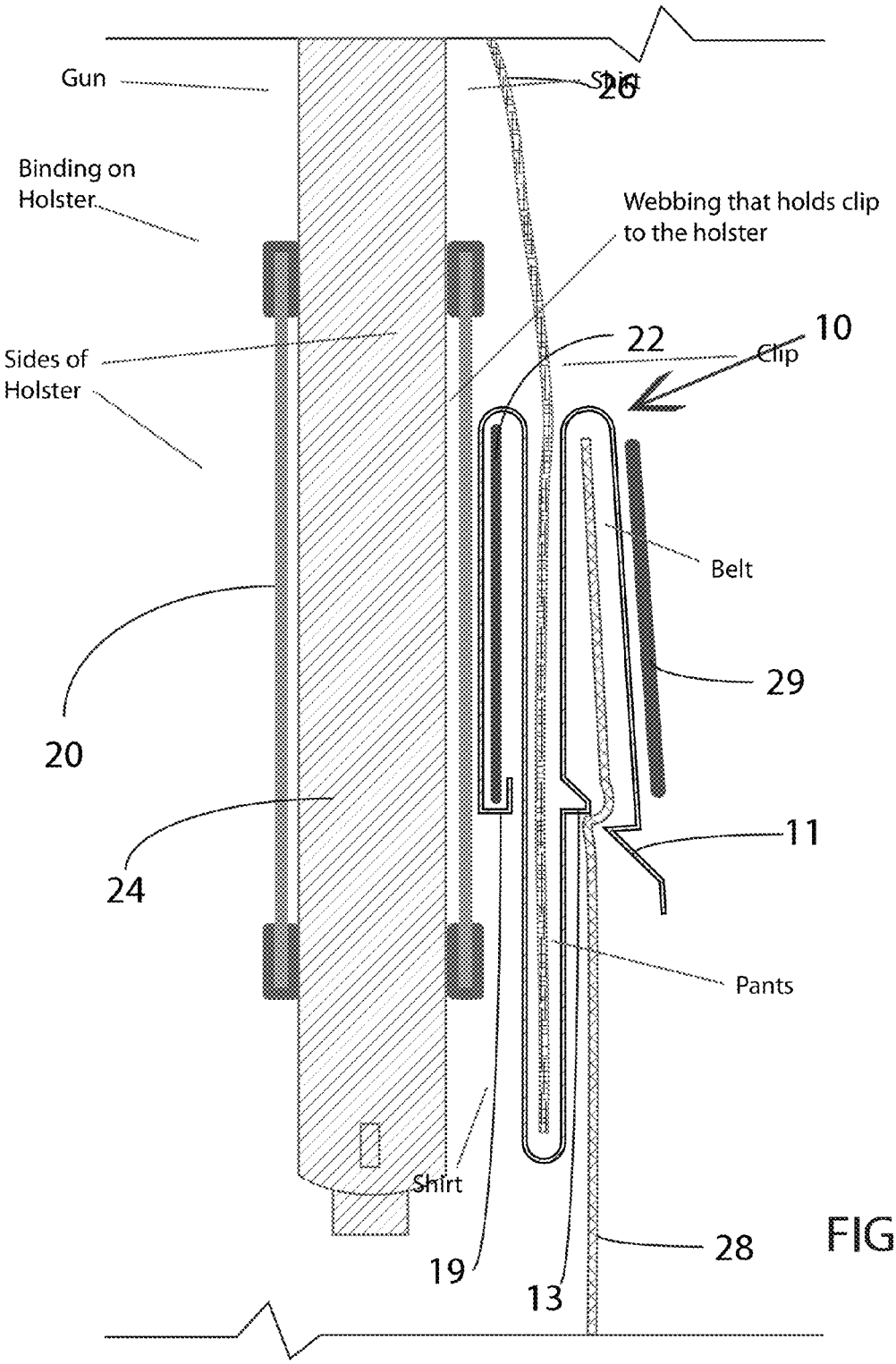
FIG. 5 is a sectional view of the holster and holster clip combination of FIG. 4, taken along line A-A.

In use, shown in FIG. 3, the clip 10 is attached to a holster 20 by threading the second outer wall 18 behind a strap 22 on the holster 20. Trough 19 then hooks around strap 22 and secures the clip 10 to the holster 20. FIGS. 4 and 5, then, depict the mode of concealment. The holster 20 is clipped onto the wearer's pants 28 by sliding the clip's first outer and inner walls 12, 14 over the pant waistband and underneath the belt 29 (if present). The tooth of the first hem 11 and the second hem 13 interface with each other and releasably hold the pants 28 between them, thereby positioning the holster 20 within the pants 28. Firearm 24 is secured in the holster 20 and the shirt 26 is then tucked into the pant waistband 28 and the tail of the shirt 26 is positioned in the space 15 between the inner walls 14, 16 of the clip 10. To access the firearm 24, the wearer merely untucks the shirt 26 and the firearm 24 may be deployed.

Figure 6:
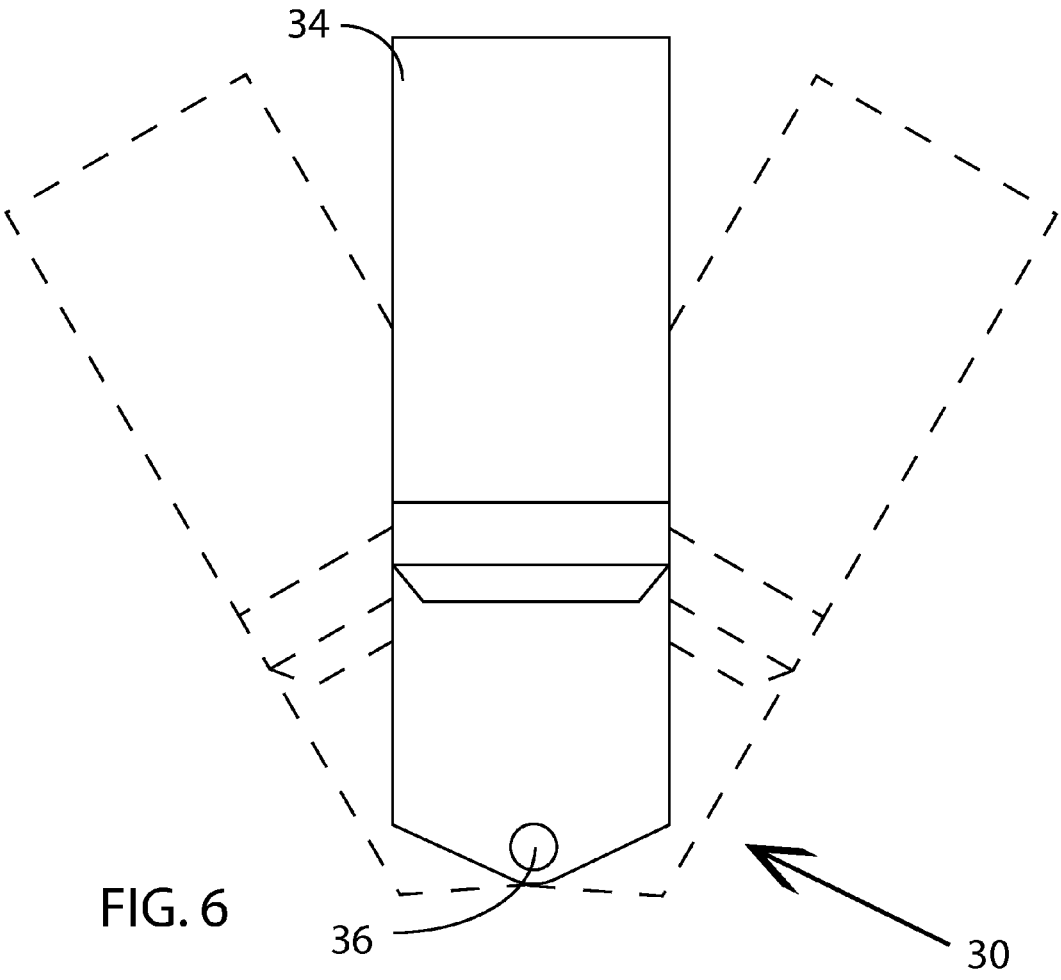
FIG. 6 is a front elevation of an alternate embodiment holster clip.

FIGS. 6-8 depict an alternate embodiment that can build a range of cant into the holster clip 30. Holster clip 30 is manufactured in two parts, an inner half 32, corresponding to second inner and outer walls 16, 18 of the first described embodiment, and an outer half 34, corresponding to first outer and inner walls 12, 14 of the first described embodiment. The two halves 32, 34 are joined at a pivot point 36 toward the bottom of the longer walls of each half. The joint may be made by any suitable means that will allow relative rotation between the halves, such as a bolt or pin. A holster clip according to this embodiment, then, will allow the holster greater movement within the waistband thus providing greater comfort to the wearer and facilitating extraction of the weapon. Another advantage of this embodiment is that a wearer may select the outer half 32 from an assortment of outer half options in order to color coordinate with the wearer's outfit and further conceal the holster. It is also conceivable that the two halves 32, 34 may be securely joined in a manner that does not allow canting.

Figure 9:
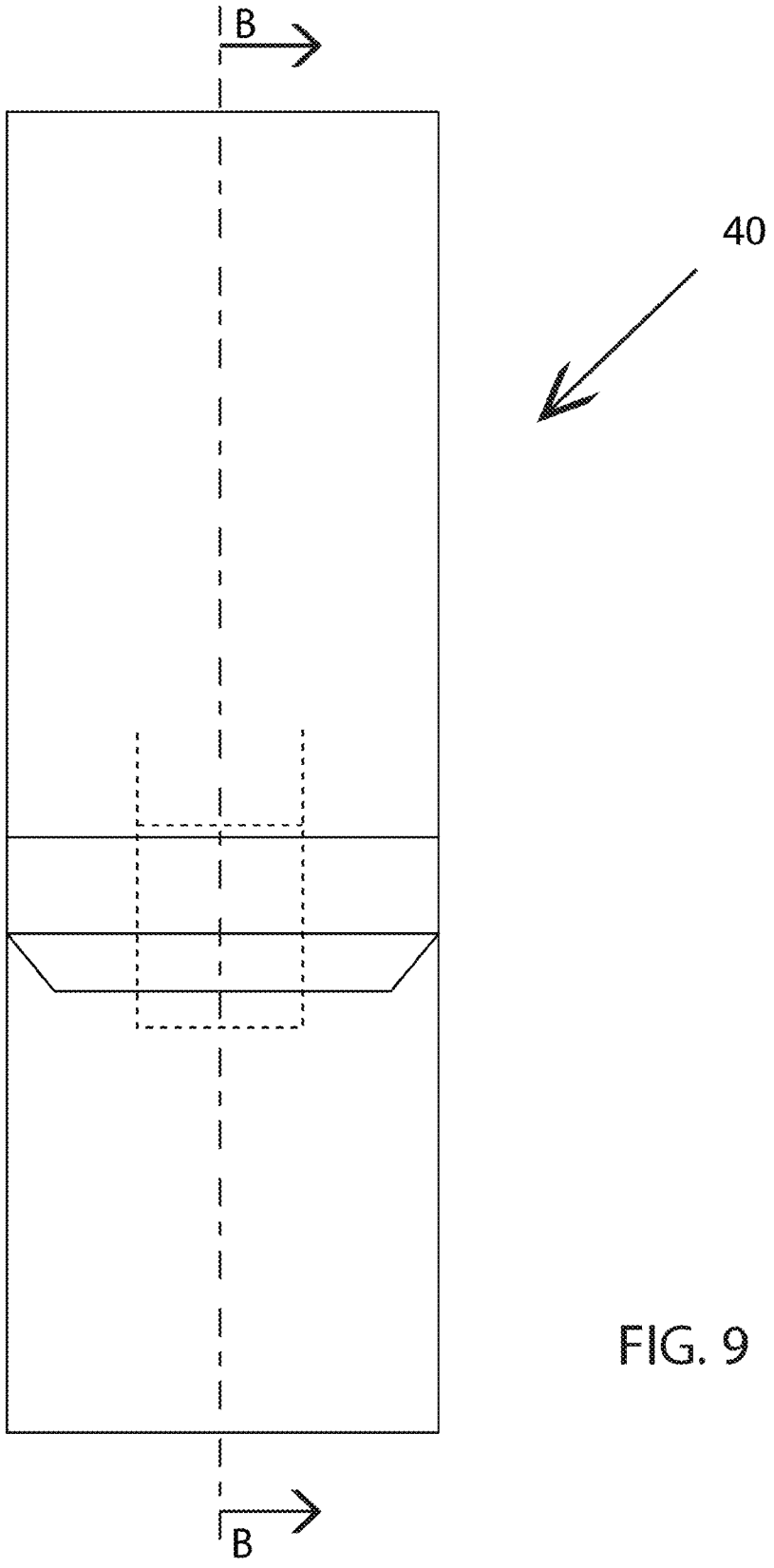
FIG. 9 is a partially transparent front elevation of an alternate embodiment holster clip.
Figure 10:
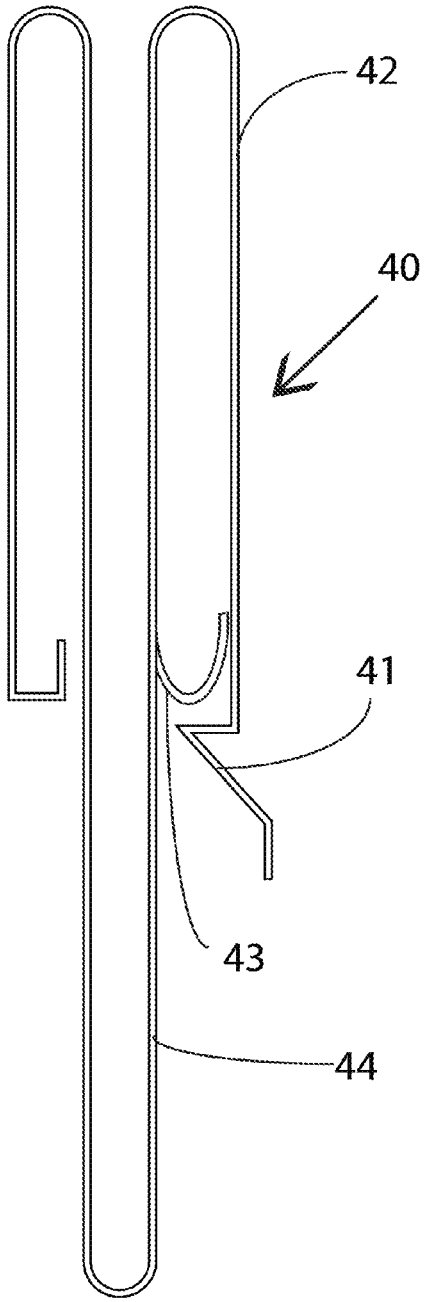
FIG. 10 is a side elevation of the holster slip of FIG. 9.
Figure 11:
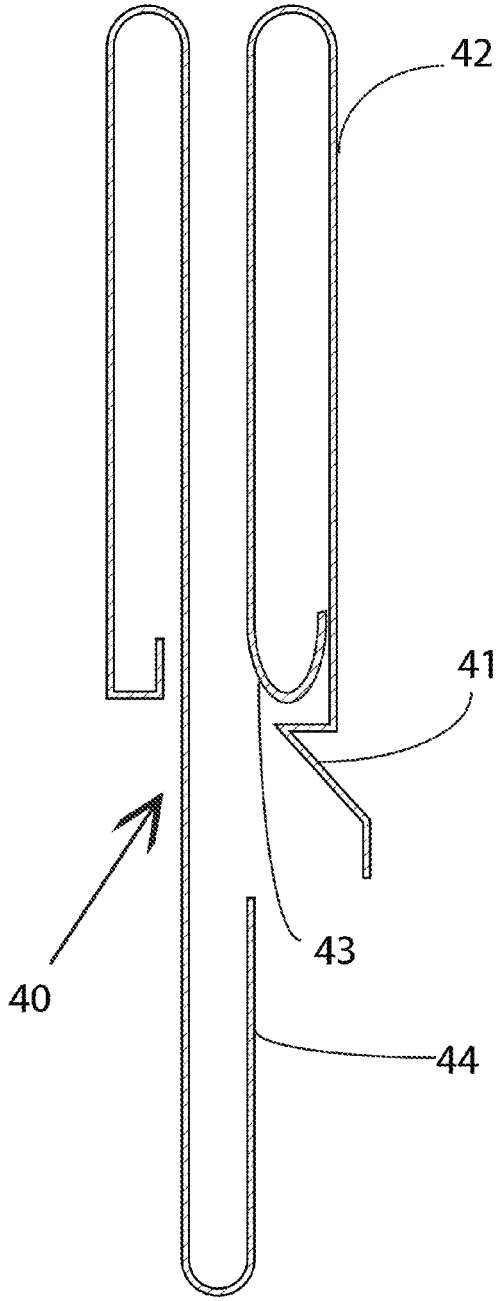
FIG. 11 is a sectional view of the holster clip of FIG. 9, taken along line B-B.

In an alternate embodiment of the clip 40, the second hem 13 is replaced with a hook 43 that is punched out of the first inner wall 44 and bent in to interface with the tooth of the hem 41 in the first outer wall 42 (FIGS. 9-11). This alteration may be utilized with either of the two embodiments disclosed above. It should also be realized that the hem structures on the first inner and first outer walls may be reversed, with the tooth being formed on the first inner wall and if utilized, the hook formed on the first outer wall. The clip may be made of any suitable material, the most suitable being metals, plastics, and composites. However, any material that may be formed into the desired shape may be utilized.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A holster clip comprising:

a. a first outer wall further comprising two ends and a first, inward facing, hem at one end;

b. a first inner wall further comprising two ends and a second, outward facing, hem located between the two ends of the first inner wall;

c. a second inner wall further comprising two ends; and d. a second outer wall, further comprising two ends, one end terminating in a trough;

wherein each wall is connected in a successive end-to-end relationship, the first inner wall being connected to the first outer wall, the second inner wall being connected to the first inner wall and the second outer wall being connected to the second inner wall such that the first and second hems interface to form a clip, a V-shaped passage is formed between the first and second inner walls and the trough is located in a passage between the second inner and second outer walls.

2. The holster clip of claim 1, the first and second inner walls being longer than the first and second outer walls.

3. The holster clip of claim 2, the first inner and outer walls being made of one piece and the second inner and outer walls being made of one piece, the two pieces being joined together at the first and second inner walls.

4. The holster clip of claim 3, the two pieces being joined in manner to allow rotation of the pieces relative to each other.

5. The holster clip of claim 4, the clip being manufactured of a material selected from the set of materials consisting of: metals, plastics and composites.

6. The holster clip of claim 1, the first inner and outer walls being made of one piece and the second inner and outer walls being made of one piece, the two pieces being joined together at the first and second inner walls.

7. The holster clip of claim 6, the two pieces being joined in manner to allow rotation of the pieces relative to each other.

8. The holster clip of claim 7, the clip being manufactured of a material selected from the set of materials consisting of: metals, plastics and composites.

9. The holster clip of claim 6, the clip being manufactured of a material selected from the set of materials consisting of: metals, plastics and composites

10. The holster clip of claim 1, the clip being manufactured of a material selected from the set of materials consisting of: metals, plastics and composites.

11. A holster clip comprising:

a. a first outer wall further comprising two ends and a first, inward facing, hem at one end;

b. a first inner wall further comprising two ends and a hook, facing outward and located between the two ends of the first inner wall;

c. a second inner wall further comprising two ends; and d. a second outer wall, further comprising two ends, one end terminating in a trough;

wherein each wall is connected in a successive end-to-end relationship, the first inner wall being connected to the first outer wall, the second inner wall being connected to the first inner wall and the second outer wall being connected to the second inner wall such that the hook and hem interface to form a clip and a V-shaped passage is formed between the first and second inner walls and the trough is located in a passage between the second inner and second outer walls.

12. The holster clip of claim 11, the first and second inner walls being longer than the first and second outer walls.

13. The holster clip of claim 12, the first inner and outer walls being made of one piece and the second inner and outer walls being made of one piece, the two pieces being joined together at the first and second inner walls.

14. The holster clip of claim 13, the two pieces being joined in manner to allow rotation of the pieces relative to each other.

15. The holster clip of claim 14, the clip being manufactured of a material selected from the set of materials consisting of: metals, plastics and composites.

16. The holster clip of claim 11, the first inner and outer walls being made of one piece and the second inner and outer walls being made of one piece, the two pieces being joined together at the first and second inner walls.

17. The holster clip of claim 16, the two pieces being joined in manner to allow rotation of the pieces relative to each other.

18. The holster clip of claim 17, the clip being manufactured of a material selected from the set of materials consisting of: metals, plastics and composites.

19. The holster clip of claim 16, the clip being manufactured of a material selected from the set of materials consisting of: metals, plastics and composites.

20. The holster clip of claim 11, the clip being manufactured of a material selected from the set of materials consisting of: metals, plastics and composites.

* * * * *